US006571913B2

(12) United States Patent
Puszkiewicz et al.

(10) Patent No.: US 6,571,913 B2
(45) Date of Patent: Jun. 3, 2003

(54) MULTIPURPOSE MACHINE

(75) Inventors: Ignacy Puszkiewicz, Smithsburg, MD (US); Sudhir Menon, Frederick, MD (US)

(73) Assignee: JLG Industries, Inc., McConnellsburg, PA (US)

( * ) Notice: Subject to any disclaimer, the term of this patent is extended or adjusted under 35 U.S.C. 154(b) by 0 days.

(21) Appl. No.: 09/922,805

(22) Filed: Aug. 7, 2001

(65) Prior Publication Data

US 2003/0029673 A1 Feb. 13, 2003

(51) Int. Cl.[7] ..... E06C 1/00
(52) U.S. Cl. ..... 182/69.1; 182/69.5; 414/495
(58) Field of Search ..... 182/16, 69.1, 69.2, 182/69.3, 69.4, 69.5, 89.6, 141; 187/226; 188/140; 414/495, 685

(56) References Cited

U.S. PATENT DOCUMENTS

| | | | | | |
|---|---|---|---|---|---|
| 6,155 | A | * | 3/1849 | Huttman et al. | 182/69.1 X |
| 3,889,782 | A | * | 6/1975 | Geis | 187/9 |
| 4,046,218 | A | * | 9/1977 | Blaisdell et al. | 180/155 |
| 4,059,172 | A | * | 11/1977 | Stedman | 187/9 E |
| 4,071,259 | A | * | 1/1978 | Ernest | 280/95 R |
| 4,335,992 | A | * | 6/1982 | Reeves | 414/667 |
| 4,395,188 | A | * | 7/1983 | Kaup | 414/622 |
| 4,413,708 | A | | 11/1983 | Stedman | |
| 4,467,893 | A | | 8/1984 | Hobson | |
| 4,690,606 | A | | 9/1987 | Ross | |
| 4,828,040 | A | * | 5/1989 | Schumacher | 172/19 |
| 5,447,331 | A | * | 9/1995 | Barnhart | 280/840 |
| 5,480,275 | A | | 1/1996 | Talbert et al. | |
| 5,525,019 | A | | 6/1996 | Moore et al. | |
| 5,630,694 | A | | 5/1997 | Ihara | |
| 5,690,465 | A | | 11/1997 | Ledwell | |
| 5,738,187 | A | | 4/1998 | Dammeyer et al. | |
| 5,829,948 | A | | 11/1998 | Becklund | |
| 5,997,013 | A | | 12/1999 | Claxton | |
| 6,044,927 | A | * | 4/2000 | Newlin | 182/69.5 |
| 6,056,304 | A | * | 5/2000 | Brambilla | 280/124.111 |
| 6,068,086 | A | | 5/2000 | Bushong et al. | |
| 6,138,812 | A | * | 10/2000 | Kimener | 193/356 |
| 6,186,272 | B1 | * | 2/2001 | Atsalakis et al. | 182/63.1 |
| 2001/0043855 | A1 | * | 11/2001 | Granroth et al. | 414/685 |
| 2002/0088665 | A1 | * | 7/2002 | Brown | 180/418 |

FOREIGN PATENT DOCUMENTS

| | | | | |
|---|---|---|---|---|
| AT | 363 222 | | 7/1981 | |
| DE | 23 31 644 | | 1/1975 | |
| DE | 10 012 627 | A1 * | 9/2001 | 182/69.1 X |
| DE | 200 20 741 | | 4/2002 | |
| FR | 2 536 735 | | 6/1984 | |
| FR | 2 750 125 | | 12/1997 | |

* cited by examiner

*Primary Examiner*—Bruce A. Lev
(74) *Attorney, Agent, or Firm*—Nixon & Vanderhye P.C.

(57) ABSTRACT

A multipurpose machine is provided with independently operable scissors lift functionality and fork lift functionality enabling the machine to perform a number of tasks such as moving personnel and tools, lifting loads, fetching parts, and easy access to equipment/material while working at heights. The machine includes a base, a platform lift mechanism defining a scissors lift secured to the base, and a platform supported by the scissors lift. A fork lifting mechanism secured to the base includes a mast assembly and lifting forks coupled with the mast assembly. The base is preferably fitted with wheels mounted on respective axles, one of which may be an oscillating axle to increase the mobility of the machine. The independent operability of a scissors lift and fork lifting mechanism in a single multipurpose machine provides versatility for numerous applications.

18 Claims, 6 Drawing Sheets

MULTIPURPOSE MACHINE

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to industrial machinery and, more particularly, to a multipurpose lifting machine that has the capability to perform multiple tasks for a variety of applications.

A number of existing machines perform limited tasks that are suitable for certain applications. Conventional scissors lifts for example perform lifting of personnel and a limited number of tools and material to heights. Similarly, conventional fork trucks lift and maneuver loads and have the ability to move them from point to point. A typical scissors lift has a base with an assembly of cross-pinned arms on which rests a platform. The platform typically has weight restrictions and is usually limited to lifting an operator and a limited amount of tools and materials. These tools and materials must be stored on the platform, thereby limiting the platform's usable space. Typical applications that require scissors lifts do not require the machine to travel at high speeds. A conventional fork truck includes a base with a cab and a mast assembly that allows forks to be raised and lowered. In contrast with the typical scissors lift, the fork truck is designed for higher speeds in order to increase productivity of moving loads across distances.

It has been observed that certain jobs require the use of both a scissors lift and a fork truck, in many cases requiring more than one operator, with inherent losses in productivity and other logistic problems in the use of two industrial machines. It would thus be desirable to improve productivity by allowing one operator to complete jobs without having to switch machines.

BRIEF SUMMARY OF THE INVENTION

The machine according to the present invention is constructed to perform a number of tasks, such as the ability to move personnel and tools, the capability to lift loads, allow personnel access to heights, fetching of parts and easy access to equipment/material while working at heights. In this context, the machine of the invention combines capabilities of a scissors lift and a fork truck, therefore providing increased versatility.

The machine design meets requirements that are found in applications such as maintenance, warehousing, electrical installation, plumbing, panel installation (drywall, insulation foam and similar panelized construction materials), welding, painting, shot blasting, etc. To support these applications, the machine can be fitted with various attachments such as a toolbox, dumpster, oxyacetylene tank carrier, panel and long material carrier and/or a platform extension. Of course, further applications of the machine according to the invention will be apparent to those of ordinary skill in the art.

In an exemplary embodiment of the present invention, a multipurpose machine includes a base, a platform lift mechanism such as a plurality of cross-pinned arms defining a scissors lift secured at a lower end thereof to the base, a platform supported by an upper end of the scissors lift, and a fork lifting mechanism secured to the base. The fork lifting mechanism includes a mast assembly and lifting forks coupled with the mast assembly. The scissors lift and the fork lifting mechanism are independently operable. Wheels may be rotatably mounted on respective axles secured to the base, where at least one of the respective axles is preferably an oscillating axle. The mast assembly may include a mast secured to a front of the base and disposed offset from a center of the front of the base. A rail may be disposed about a periphery of the platform including a gate that permits access to the lifting forks of the fork lifting mechanism. The lifting forks are preferably pivotally secured to the mast assembly such that the lifting forks can be pivoted between a use position and a stowed position.

In accordance with another exemplary embodiment of the invention, a multipurpose machine includes a vehicle base with a chassis supporting front wheels and rear wheels rotatably mounted on respective axles secured to the vehicle base. A vehicle driving and control system providing motive power to the front and rear wheels and including a steering mechanism is coupled with at least one of the front or rear wheels for controlling steering of the machine. A platform lift mechanism such as a plurality of cross-pinned arms defining a scissors lift are secured at a lower end thereof to the vehicle base and operatively coupled with the vehicle driving and control system. The platform is supported by an upper end of the scissors lift. Finally, the multipurpose machine additionally includes a fork lifting mechanism secured to the vehicle base and operatively coupled with the vehicle driving and control system. In this context, the scissors lift and the fork lifting mechanism are independently operable via the vehicle driving and control system. The steering mechanism may be coupled with the rear wheels to effect rear wheel steering of the machine or alternatively may be coupled with the front wheels to effect front wheel steering of the machine.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
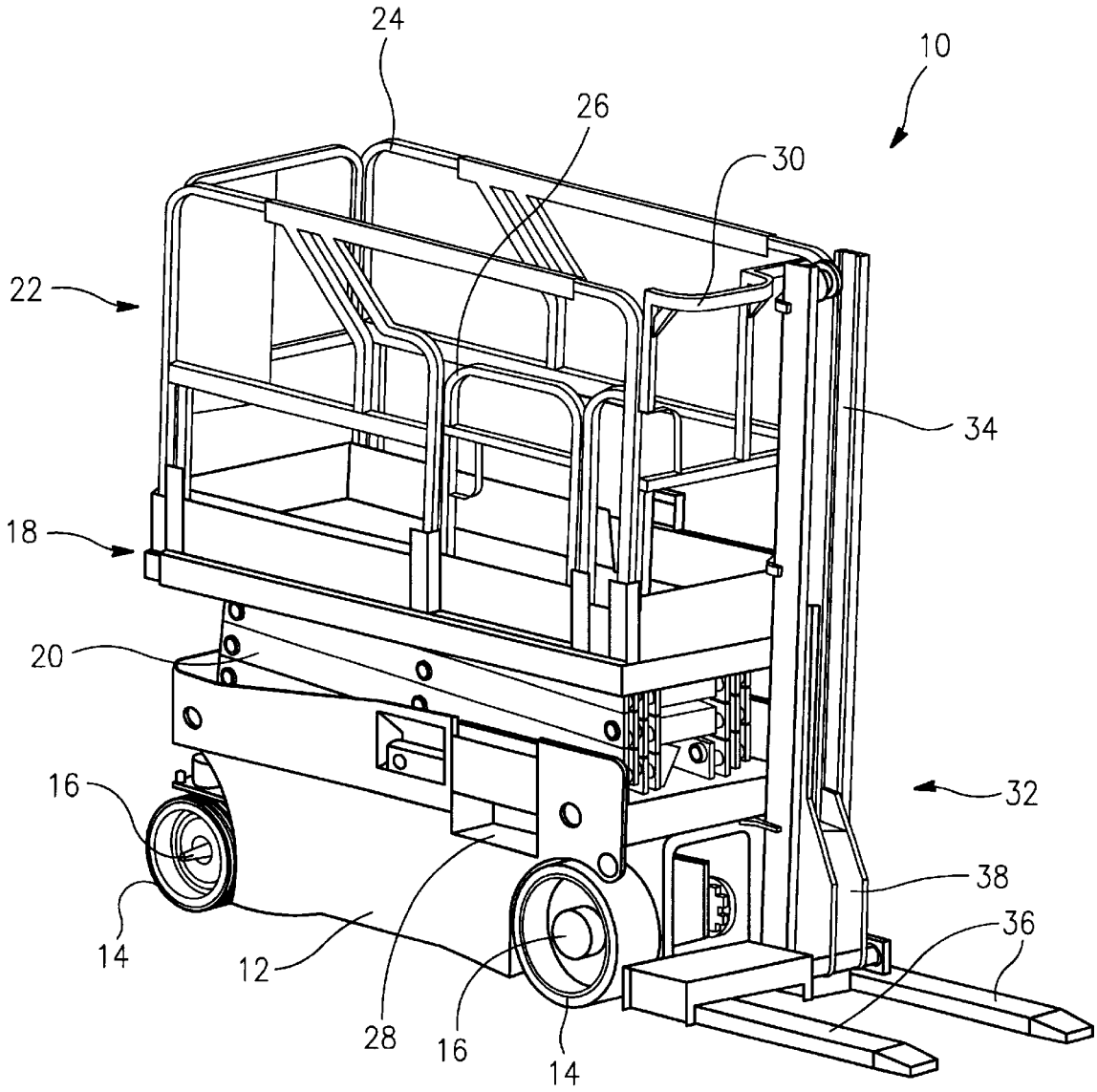
FIG. 1 is a perspective view of the multipurpose machine according to the present invention.
Figure 2:
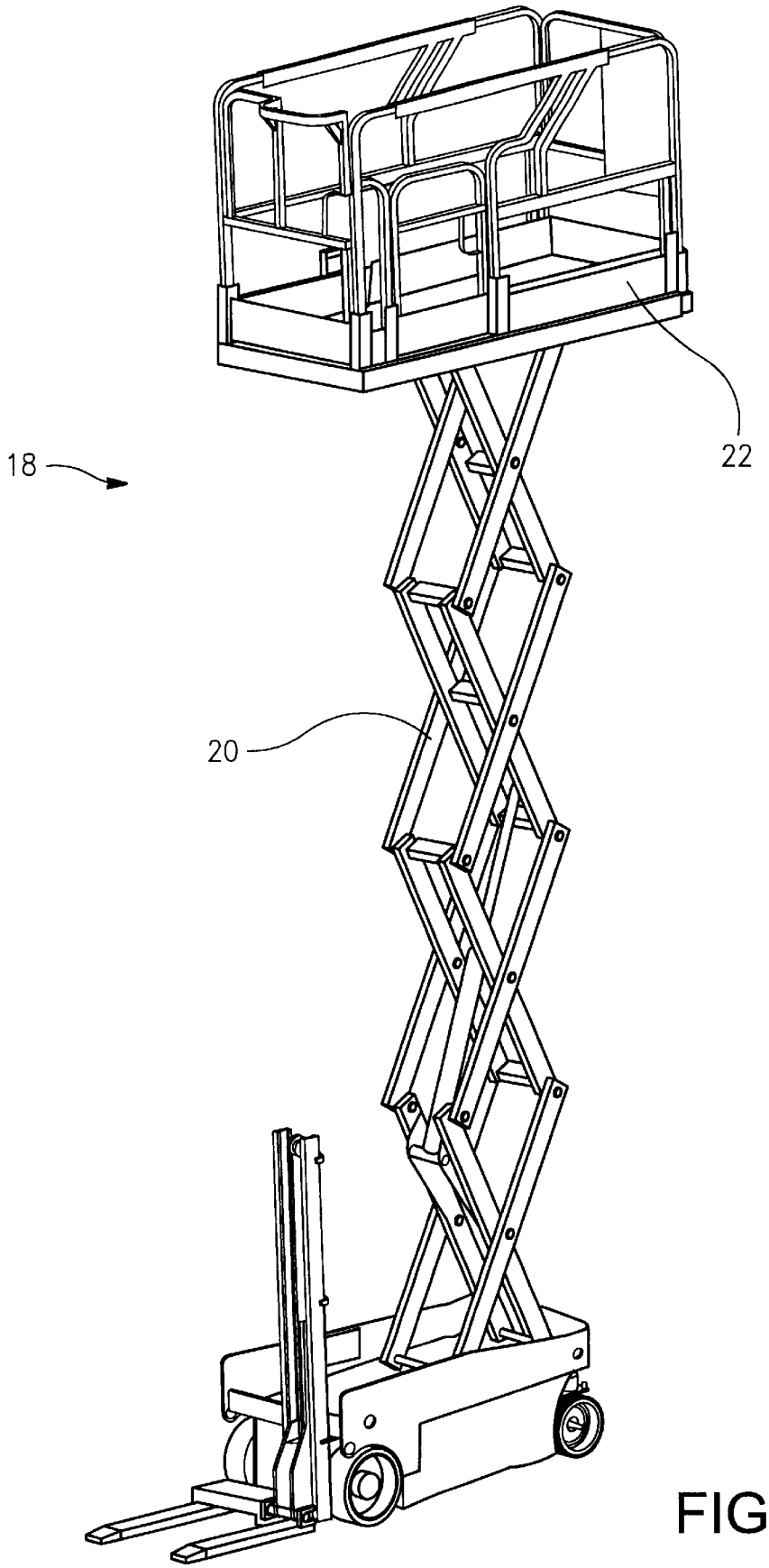
FIG. 2 illustrates the machine with the scissors lift in a raised position.

With reference to FIGS. 1 and 2, the multipurpose machine 10 according to the invention includes a vehicle base 12 including a chassis that supports a plurality of wheels 14 mounted on respective axles 16. A scissors lift 18 is secured at a lower end to the base 12 and includes a plurality of cross-pinned arms 20 that are extended and retracted between raised and lowered positions, respectively. The construction of the cross-pinned arms 20 that configure the scissors lift is known, and further details thereof will not be described. The scissors lift 18 may encompass alternative types of platform lift mechanisms, and the invention is not necessarily meant to be limited to the illustrated cross-pinned arms construction. The scissors lift 18 is shown in a lowered position in FIG. 1 and a raised position in FIG. 2.

A platform 22 is supported at an upper end of the scissors lift 18. The platform 22 is sized based on safety standards determined according to the size of the base 12 and includes a safety rail (handrail) 24 around its perimeter. An entrance gate 26 is provided at a convenient position such as adjacent a step 28 formed in the base to facilitate entry by a workman. An access gate 30 is also preferably provided at a front section of the safety rail 24. The access gate 30 provides access by the workman to material supported by the fork lifting mechanism (described below).

Figure 3:
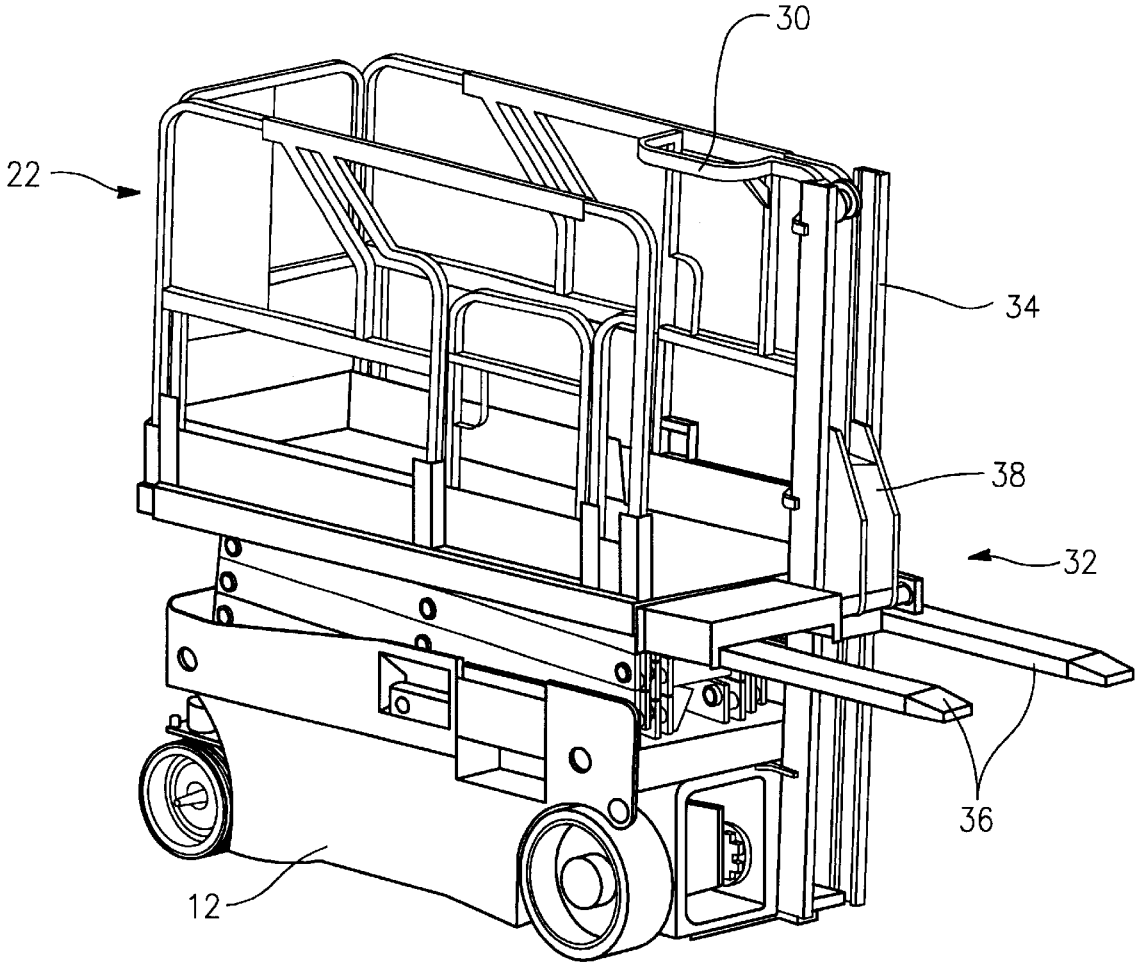
FIG. 3 illustrates the platform railing access to a load carried by the forks.
Figure 4:
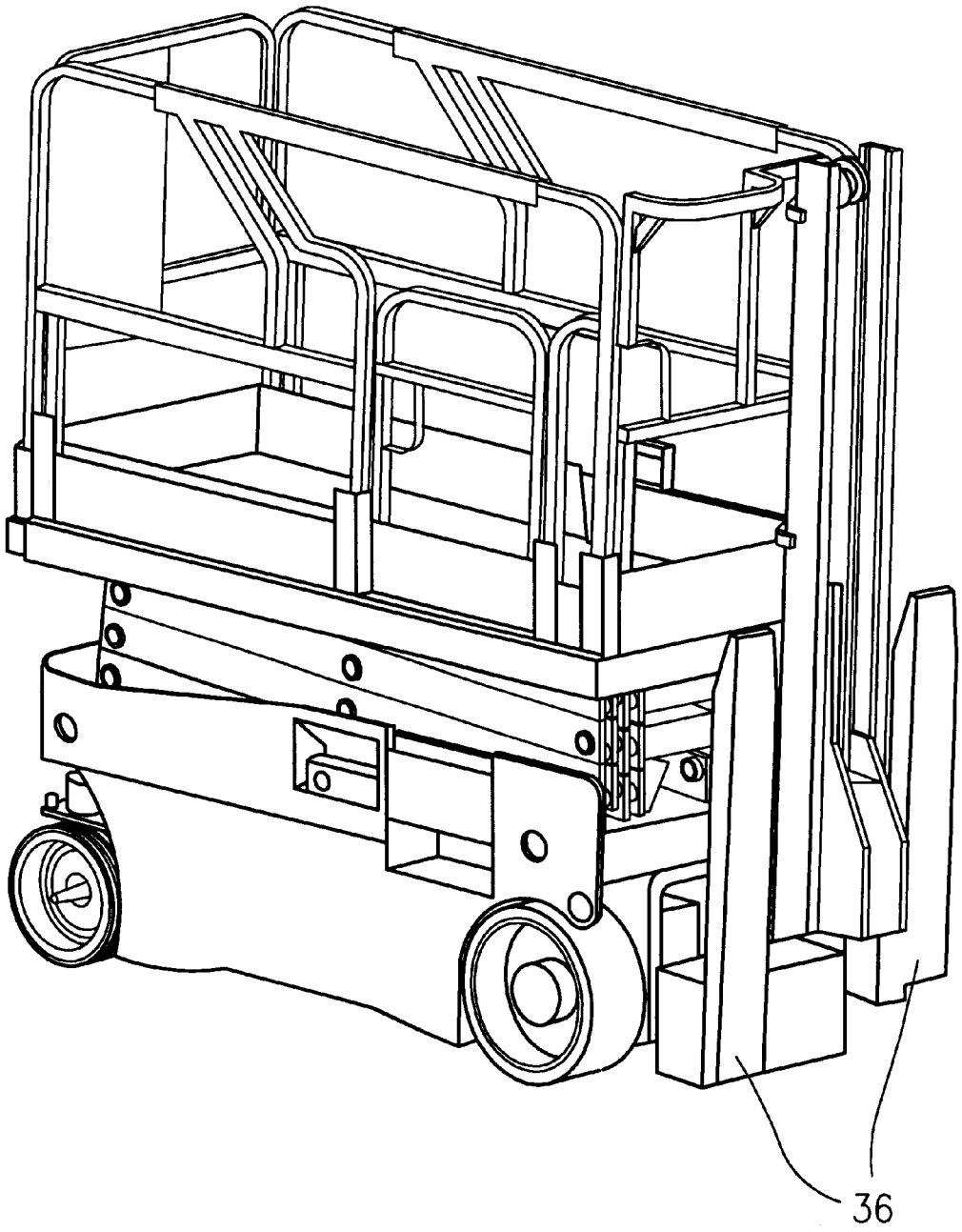
FIG. 4 shows the fork lifting mechanism with the forks pivoted to a stowed position.

The multipurpose machine 10 according to the invention also includes a fork lifting mechanism 32 substantially of conventional construction including a mast assembly 34 and lifting forks 36 coupled with the mast assembly 34 via a fork carrier 38 or the like. In a preferred arrangement, the lifting forks 36 are pivotally supported by the fork carrier 38 between a use position as shown in FIGS. 1–3 and a stowed position shown in FIG. 4. Pivoting the lifting forks 36 (with the mast 34 fixed in relation to the machine 10) is a unique solution since a typical fork lift has a tilting mast, i.e., a mast that is pivoted to the frame and positioned with a hydraulic cylinder. The fork lifting mechanism 32 in the multipurpose machine 10 according to the present invention allows for both pivoting of the lifting forks 36 to a stowed position (FIG. 4) to shorten the machine for better maneuverability and also allows for a small tilt as with conventional constructions to prevent spilling of the load when traveling. The lifting forks 36 may be pivoted manually or via some actuating means or the like.

In contrast with conventional fork lifting mechanism construction, the mast assembly 34 of the invention is disposed offset from a center of the front of the base 12 as shown. As such, a workman can have unobstructed access from the platform 22 to material carried by the forks 36 via the access gate 30. FIG. 3 shows the fork lifting mechanism 32 with the forks 36 raised to the level of the platform 22. As shown in FIG. 3, with the access gate 30 open, a workman can readily access the material loaded on the forks 36.

Figure 6:
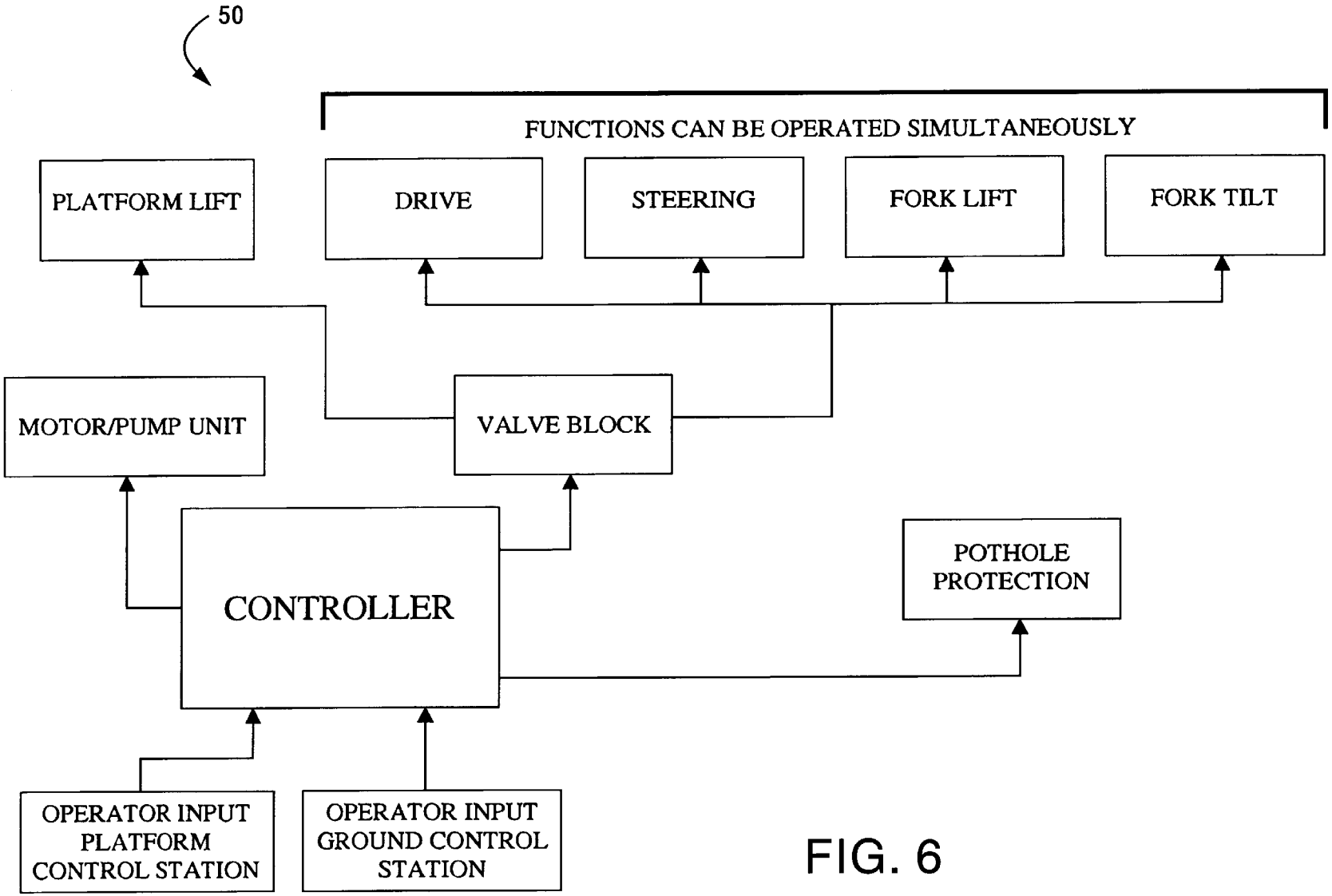
FIG. 6 is a schematic block diagram of a vehicle driving and control system.

A vehicle driving and control system 50 (FIG. 6) is contained within the vehicle base 12. The vehicle driving and control system 50 provides motive power to the front and/or rear wheels and includes a steering mechanism coupled with at least one of the front or rear wheels for controlling steering of the machine. The construction and operation of the vehicle driving and control system are known, and further details will not be described. Referring to FIG. 6, the driving and control system is operatively coupled with the scissors lift 18 and the fork lifting mechanism 32 such that the scissors lift and the fork lifting mechanism are independently operable. That is, the vehicle driving and control system 50 includes separate controls for operation of the scissors lift 18 and the fork lifting mechanism 32. Any suitable conventional driving/lifting structure can be used such as, for example, hydraulic lifts, electro-mechanical actuators, hydraulic or electric motors with or without gear box for drive function, or the like. The driving and control system of the machine also allows certain functions to be operated simultaneously and regulates functionality to maintain safety. Simultaneous operation is limited to during drive/steering function, and all other functions are prohibited during scissor (platform) lift.

Figure 5:
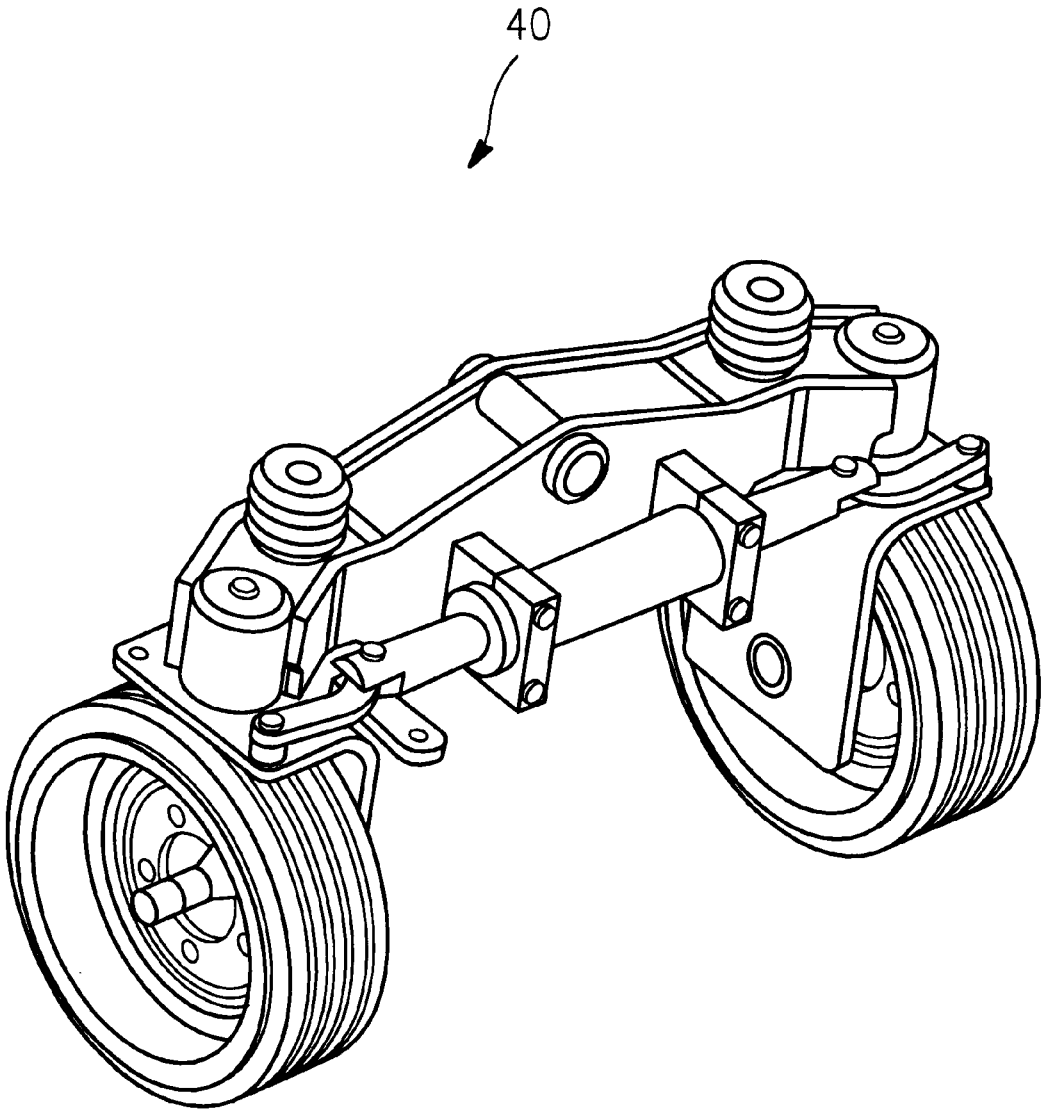
FIG. 5 illustrates an exemplary oscillating axle for the machine of the present invention.

As discussed above, a typical scissors lift is used for applications that do not require travel at high speeds. Fork lifting mechanism applications, however, typically require higher speed travel for increased productivity of moving loads across distances. The multipurpose machine 10 according to the invention is preferably provided with an oscillating axle 40, an example of which is shown in FIG. 5, which enables the machine 10 to move loads on uneven ground conditions and at higher speeds. Such axles are known in existing forklift and rough terrain scissors designs, and details thereof will not be described.

A number of attachments can be interchangeably fitted with the machine to support various applications. Examples of such attachments include a toolbox, oxyacetylene tank carrier, panel and long material carrier (via a side load attachment or the like), platform extension, etc. Of course, those of ordinary skill in the art will contemplate alternative applications and attachments.

With the structure of the multipurpose machine according to the present invention, a machine is provided that includes the functionality of both a scissors lift and a fork truck. By combining functionality, productivity can be improved by allowing one operator to complete jobs without having to switch machines. Moreover, the construction minimizes problems related to weight restrictions on platforms of scissors lifts and provides a readily adaptable machine that can be configured for specific applications.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A multipurpose machine comprising:

a base;

a platform lift mechanism defining a scissors lift secured at a lower end thereof to the base;

a platform supported by an upper end of the scissors lift; and a fork lifting mechanism secured to the base, the fork lifting mechanism including a mast assembly and lifting forks coupled with the mast assembly via a fork carrier, the fork carrier being movably displaceable along the mast assembly to raise and lower the lifting forks, wherein the scissors lift and the fork lifting mechanism are independently operable.

2. A multipurpose machine according to claim 1, further comprising wheels rotatably mounted on respective axles secured to the base, wherein at least one of the respective axles is an oscillating axle.

3. A multipurpose machine according to claim 1, wherein the lifting forks are pivotally secured to the mast assembly such that the lifting forks are pivotable between a use position and a stowed position.

4. A multipurpose machine according to claim 1, wherein the platform lift mechanism comprises a plurality of cross-pinned arms.

5. A multipurpose machine comprising:

a base;

a platform lift mechanism defining a scissors lift secured at a lower end thereof to the base;

a platform supported by an upper end of the scissors lift; and a fork lifting mechanism secured to the base, the fork lifting mechanism including a mast assembly and lifting forks coupled with the mast assembly, wherein the scissors lift and the fork lifting mechanism are independently operable, and wherein the mast assembly comprises a mast secured to a front of the base and disposed offset from a center of the front of the base.

6. A multipurpose machine comprising:

a base;

a platform lift mechanism defining a scissors lift secured at a lower end thereof to the base;

a platform supported by an upper end of the scissors lift; and a fork lifting mechanism secured to the base, the fork lifting mechanism including a mast assembly and lifting forks coupled with the mast assembly, wherein the scissors lift and the fork lifting mechanism are independently operable, wherein the platform comprises a rail disposed about a periphery thereof, the rail including a gate that permits access to the lifting forks of the fork lifting mechanism, and wherein the mast assembly comprises a mast secured to a front of the base and disposed offset from a center of the front of the base, thereby providing unobstructed access to the lifting forks via the gate.

7. A multipurpose machine comprising:

a vehicle base including a chassis supporting front wheels and rear wheels rotatably mounted on respective axles secured to the vehicle base;

a vehicle driving and control system providing motive power to the front and rear wheels and including a steering mechanism coupled with at least one of the front or rear wheels for controlling steering of the machine;

a platform lift mechanism defining a scissors lift secured at a lower end thereof to the vehicle base and operatively coupled with the vehicle driving and control system;

a platform supported by an upper end of the scissors lift; and a fork lifting mechanism secured to the vehicle base and operatively coupled with the vehicle driving and control system, the fork lifting mechanism including a mast assembly and lifting forks coupled with the mast assembly via a fork carrier, the fork carrier being movably displaceable along the mast assembly to raise and lower the lifting forks, wherein the scissors lift and the fork lifting mechanism are independently operable via the vehicle driving and control system.

8. A multipurpose machine according to claim 7, wherein at least one of the respective axles is an oscillating axle.

9. A multipurpose machine according to claim 7, wherein the lifting forks are pivotally secured to the mast assembly such that the lifting forks are pivotable between a use position and a stowed position.

10. A multipurpose machine according to claim 7, wherein the steering mechanism is coupled with the rear wheels to effect rear wheel steering of the machine.

11. A multipurpose machine according to claim 7, wherein the steering mechanism is coupled with the front wheels to effect front wheel steering of the machine.

12. A multipurpose machine according to claim 7, wherein the platform lift mechanism comprises a plurality of cross-pinned arms.

13. A multipurpose machine comprising:

a vehicle base including a chassis supporting front wheels and rear wheels rotatably mounted on respective axles secured to the vehicle base;

a vehicle driving and control system providing motive power to the front and rear wheels and including a steering mechanism coupled with at least one of the front or rear wheels for controlling steering of the machine;

a platform lift mechanism defining a scissors lift secured at a lower end thereof to the vehicle base and operatively coupled with the vehicle driving and control system;

a platform supported by an upper end of the scissors lift; and a fork lifting mechanism secured to the vehicle base and operatively coupled with the vehicle driving and control system, the fork lifting mechanism including a mast assembly and lifting forks coupled with the mast assembly, wherein the scissors lift and the fork lifting mechanism are independently operable via the vehicle driving and control system, and wherein the mast assembly comprises a mast secured to a front of the base and disposed offset from a center of the front of the base.

14. A multipurpose machine comprising:

a vehicle base including a chassis supporting front wheels and rear wheels rotatably mounted on respective axles secured to the vehicle base;

a vehicle driving and control system providing motive power to the front and rear wheels and including a steering mechanism coupled with at least one of the front or rear wheels for controlling steering of the machine;

a platform lift mechanism defining a scissors lift secured at a lower end thereof to the vehicle base and operatively coupled with the vehicle driving and control system;

a platform supported by an upper end of the scissors lift; and a fork lifting mechanism secured to the vehicle base and operatively coupled with the vehicle driving and control system, the fork lifting mechanism including a mast assembly and lifting forks coupled with the mast assembly, wherein the scissors lift and the fork lifting mechanism are independently operable via the vehicle driving and control system, wherein the platform comprises a rail disposed about a periphery thereof, the rail including a gate that permits access to the lifting forks of the fork lifting mechanism, and wherein the mast assembly comprises a mast secured to a front of the base and disposed offset from a center of the front of the base, thereby providing unobstructed access to the lifting forks via the gate.

15. A multipurpose machine comprising:

a base;

a platform lift mechanism defining a scissors lift secured at a lower end thereof to the base;

a fork lifting mechanism secured to the base, the fork lifting mechanism including a mast assembly and lifting forks pivotally coupled with the mast assembly, wherein the scissors lift and the fork lifting mechanism are independently operable;

a platform supported by an upper end of the scissors lift, the platform including a rail disposed about a periphery thereof including a gate that permits access to the lifting forks of the fork lifting mechanism, wherein the mast assembly comprises a mast secured to a front of the base and disposed offset from a center of the front of the base, thereby providing unobstructed access to the lifting forks via the gate.

16. A multipurpose machine according to claim 15, further comprising wheels rotatably mounted on respective axles secured to the base, wherein at least one of the respective axles is an oscillating axle.

17. A multipurpose machine according to claim 15, wherein the platform lift mechanism comprises a plurality of cross-pinned arms.

18. A multipurpose machine that combines scissors lift functionality and fork truck functionality in a single machine with independent operability, the multipurpose machine comprising a base supporting a scissors lift including a platform and a fork lifting mechanism including a pair of lifting forks movably displaceable along a mast assembly to raise and lower the forks via a fork carrier coupled with the mast assembly, wherein the platform and lifting forks are cooperatively adaptable for specific applications.

* * * * *